US009920909B2

(12) United States Patent
Aboulnaga et al.

(10) Patent No.: US 9,920,909 B2
(45) Date of Patent: Mar. 20, 2018

(54) LIGHTING DRIVER AND HOUSING HAVING INTERNAL ELECTROMAGNETIC SHIELDING LAYER CONFIGURED FOR DIRECT CONNECTION TO CIRCUIT GROUND

(71) Applicant: PHILIPS LIGHTING HOLDING B.V., Eindhoven (NL)

(72) Inventors: Aly Aboulnaga, Des Plaines, IL (US); Robert Paul Miller, Schaumburg, IL (US)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 78 days.

(21) Appl. No.: 14/375,453

(22) PCT Filed: Feb. 1, 2013

(86) PCT No.: PCT/IB2013/050851

§ 371 (c)(1),
(2) Date: Jul. 30, 2014

(87) PCT Pub. No.: WO2013/114323

PCT Pub. Date: Aug. 8, 2013

(65) Prior Publication Data

US 2015/0015152 A1 Jan. 15, 2015

Related U.S. Application Data

(60) Provisional application No. 61/594,399, filed on Feb. 3, 2012.

(51) Int. Cl.
*H05B 31/04* (2006.01)
*F21V 15/01* (2006.01)
(Continued)

(52) U.S. Cl.
CPC ..... *F21V 15/01* (2013.01); *F21V 23/008* (2013.01); *H05B 33/0815* (2013.01); *H05B 33/0884* (2013.01); *H05B 37/00* (2013.01)

(58) Field of Classification Search
CPC ..... H05B 33/0803; H05B 33/0842; H05B 33/0821; H05B 33/0809; H05B 33/0815;
(Continued)

(56) References Cited

U.S. PATENT DOCUMENTS 5,534,663 A 7/1996 Rivers et al.
5,749,178 A 5/1998 Garmong
(Continued)

FOREIGN PATENT DOCUMENTS

CN 1355603 A 6/2002
CN 101026938 A 8/2007
(Continued)

*Primary Examiner* — Kretelia Graham
*Assistant Examiner* — Henry Luong
(74) *Attorney, Agent, or Firm* — Akarsh P. Belagodu

(57) ABSTRACT

An apparatus (200, 300, 400, 500) includes a lighting driver circuit (210, 310, 410, 510) and a housing (220, 420, 520) in which the lighting driver circuit is disposed. The lighting driver circuit is configured to receive an input voltage (10) between a pair of input terminals (305) and in response thereto to supply power to one or more light sources (20). The housing has an electrically insulating inner surface (222, 422, 522) and an electrically insulating outer surface (228, 428, 528) and an electrically conductive electromagnetic shield layer (226, 426, 526). The electrically conductive electromagnetic shield layer is disposed between the electrically insulating inner surface and the outer electrically insulating surface. The lighting driver circuit is electrically connected to the electrically conductive electromagnetic shield layer of the housing.

18 Claims, 7 Drawing Sheets

(51) Int. Cl.
*H05B 33/08* (2006.01)
*F21V 23/00* (2015.01)
*H05B 37/00* (2006.01)

(58) Field of Classification Search
CPC .... H05B 33/0884; H05B 37/00; H05B 31/04; F21Y 2101/02; F21Y 2105/001; F21Y 2111/007; F21Y 2103/022; F21Y 2111/005; F21V 15/01; F21V 23/007; H05K 9/00; H01Q 5/40
USPC ..... 315/209 R, 291, 276, 113, 200 R, 185 R, 315/88, 312, 85; 362/219, 222, 237, 294, 362/373, 800, 240, 248, 632–634, 544, 362/546, 217.1, 362
See application file for complete search history.

(56) References Cited

U.S. PATENT DOCUMENTS 5,866,991 A * 2/1999 Farkas ..... H05B 41/24 313/153
6,933,677 B1 * 8/2005 Karpen ..... 315/85
8,110,973 B2 * 2/2012 Richard ..... H01J 5/48 313/113
2002/0172037 A1 * 11/2002 Schnaufer ..... F21L 14/026 362/221
2005/0106403 A1 * 5/2005 Yui ..... B32B 15/04 428/469
2008/0043473 A1 * 2/2008 Matsui ..... 362/294
2008/0106200 A1 * 5/2008 Hori ..... H01J 11/34 313/582
2009/0279310 A1 * 11/2009 Freeman ..... H01J 5/60 362/310
2009/0310212 A1 * 12/2009 Shin ..... G02B 5/22 359/359
2010/0102729 A1 4/2010 Katzir et al.
2010/0117545 A1 * 5/2010 Kelly ..... H02M 1/4225 315/152
2010/0128479 A1 * 5/2010 Biebl et al. ..... 362/249.02
2010/0134016 A1 * 6/2010 York et al. ..... 315/113
2011/0038172 A1 * 2/2011 Vollmer ..... F21S 48/1154 362/543
2011/0227471 A1 9/2011 Richard et al.
2012/0020104 A1 * 1/2012 Biebl et al. ..... 362/546
2012/0033429 A1 * 2/2012 Van De Ven ..... 362/294
2012/0091970 A1 * 4/2012 Cho ..... H02J 7/022 320/160
2012/0155087 A1 * 6/2012 Kim et al. ..... 362/249.03
2013/0235586 A1 * 9/2013 Gielen et al. ..... 362/294

FOREIGN PATENT DOCUMENTS

CN 200961800 Y 10/2007
CN 202009367 U 10/2011
JP 1986149494 U 7/1986
JP 1986210699 9/1986
JP 62111789 A 5/1987
JP 2002112147 A 4/2002
JP 2003274318 A 9/2003
JP 2010016024 A 1/2010

* cited by examiner

LIGHTING DRIVER AND HOUSING HAVING INTERNAL ELECTROMAGNETIC SHIELDING LAYER CONFIGURED FOR DIRECT CONNECTION TO CIRCUIT GROUND

CROSS-REFERENCE TO PRIOR APPLICATIONS

This application is the U.S. National Phase application under 35 U.S.C. § 371 of International Application No. PCT/IB13/050851 filed on Feb. 1, 2013, which claims the benefit of U.S. Provisional Patent Application No. 61/594,399, filed on Feb. 3, 2012. These applications are hereby incorporated by reference herein.

TECHNICAL FIELD

The present invention is directed generally to electronic circuits and housings for electronic circuits. More particularly, various inventive methods and apparatus disclosed herein relate to a housing for an electronic circuit, specifically including a lighting driver circuit, which has an internal electromagnetic shielding layer that is configured for direct connection to the circuit's electrical ground.

BACKGROUND

Lighting systems typically include one or more light sources which is/are driven by a lighting driver. The lighting driver receives an input voltage and supplies power to the light source(s) in a format that is tailored to the requirements of the light source(s). In general, the lighting driver includes an electronic circuit and a housing for the electronic circuit.

A housing for an electronic circuit, and, in particular, a lighting driver circuit, may serve several purposes. One purpose of a typical electronics housing is to protect the electronic circuit (e.g. printed circuit board (PCB) assembly) from physical damage. Another purpose is to prevent an electrical shock which might occur if a human being comes into contact with the electronic circuit. Still another purpose is to insulate to PCB assembly from electrically shorting to nearby objects, such as a light source. Yet another purpose is to secure the PCB assembly and provide a means for it to be mounted or attached in a lighting fixture.

Lighting driver circuits, and particularly lighting driver circuits for light emitting diode (LED) light sources, can exhibit a relatively high leakage current. Also, it is often advantageous to have multiple LED lighting drivers within a single lighting unit. If a single LED lighting driver exhibits a relatively high leakage current, the use of multiple LED lighting drivers would be prohibited.

Therefore, the leakage current of the lighting driver circuit should be minimized to meet safety standards and to reduce or eliminate the danger of electrical shock. Accordingly, among other requirements, a main requirement for a housing for a lighting driver circuit is reducing or eliminating this leakage current. Also, for safety reasons, the housing needs to provide a protective isolation between the voltages of the lighting driver circuit and an external human being who may come into contact with the lighting driver.

To satisfy this requirement, some housings may be made of an electrically insulating material, such as a plastic. However, such housings have some drawbacks. For example, a plastic housing may not adequately shield the lighting driver circuit from external electromagnetic interference (EMI). Additionally, a plastic housing will not reduce the radiation emissions from the lighting driver circuit, which may exceed legally regulated emission limits. Furthermore, a large common mode current may be generated by the lighting driver circuit and the plastic housing cannot reduce this current. This will increase the overall radiated and conducted emissions of the lighting driver circuit unless a common mode filter with large capacitors is added.

To shield the lighting driver circuit from external EMI and to reduce the radiated emissions from the lighting driver circuit, some housings may be made of ferromagnetic material such as a metal, for example steel. The metallic housing may also serve as a heat sink, or may be directly connected to a heat sink, for the lighting driver circuit. The metallic housing may be directly connected to so-called "earth ground" for example via an input terminal connected to the lighting driver (e.g., via the "G" or green electrical wire in many electrical installations). Also, one or more safety capacitors may be provided between the metallic housing and the electrical ground of the lighting driver circuit to protect a human being from electrical shock. However such housings also have some drawbacks. For example, if larger safety capacitors are employed so as to lower their impedance and thereby reduce the common mode noise from the lighting driver circuit, then the leakage current from the lighting driver circuit will increase. On the other hand, if smaller safety capacitors are employed so as to lower their impedance and thereby reduce the leakage current from the lighting driver circuit, then the common mode noise from the lighting driver circuit will increase. Furthermore, these safety capacitors clamp the common mode surge capability of the lighting driver circuit, which is undesirable in many applications.

Thus, there is a need in the art to provide a housing for an electronic circuit, and in particular for a lighting driver circuit, which can address one or more of the drawbacks discussed above.

SUMMARY

The present disclosure is directed to inventive methods and apparatus for packaging an electronic circuit, and particularly a lighting driver circuit. For example, the present disclosure describes embodiments of an apparatus including a housing for a lighting driver circuit which can provide exterior electrical insulation for safety, interior electrical insulation for preventing any electrical shorts, and an electromagnetic shielding layer for reducing electromagnetic interference (EMI) both to and from the lighting driver circuit.

Generally, in one aspect, the invention relates to an apparatus that includes a housing and a lighting driver circuit. The housing includes a base, a plurality of walls connected to the base and to each other and each extending substantially perpendicularly from the base, and a cover separated from and spaced apart from the base and extending substantially perpendicularly to the walls and substantially in parallel with the base so as to define an enclosed space between the base, the cover and the walls. The base, the cover, and the walls each include an electrically insulating inner surface and an electrically insulating outer surface and an electrically conductive electromagnetic shield layer comprising a ferromagnetic material. The electrically conductive electromagnetic shield layer is disposed between the electrically insulating inner surface and the outer electrically insulating surface. The lighting driver circuit includes a circuit board and a plurality of electrical components mounted on the circuit board. The lighting driver circuit is configured to receive an input voltage between a pair of input terminals and in response thereto to supply power to one or more light sources. The lighting driver circuit is disposed within the enclosed space such that the electrically insulating inner layers of the housing are disposed between the lighting driver circuit and the electrically conductive electromagnetic shield layers of the housing. A ground point of the lighting driver circuit is electrically connected to at least one of the electrically conductive electromagnetic shield layers of the housing via a single electrical connection.

In one or more embodiments, the electrically conductive electromagnetic shield layers of the housing are all connected together.

In one or more embodiments, the single electrical connection between the lighting driver circuit and the electrically conductive electromagnetic shield layer includes one of a screw, a rivet, and a bolt. In one version of these embodiments, the electrically conductive electromagnetic shield layer of the housing includes a boss which extends through a hole in the electrically insulating inner surface of the housing. In other version of these embodiments, the boss is threaded, wherein the single electrical connection includes a screw or a bolt, and wherein the screw or bolt is inserted within the threaded boss.

In one or more embodiments, the base, the cover, and the walls each further include a copper layer disposed between the electrically conductive electromagnetic shield layer and the electrically insulating inner surface.

Generally, in another aspect, the invention relates to an apparatus that includes a lighting driver circuit and a housing in which the lighting driver circuit is disposed. The lighting driver circuit is configured to receive an input voltage between a pair of input terminals and in response thereto to supply power to one or more light sources. The housing has an electrically insulating inner surface and an electrically insulating outer surface and an electrically conductive electromagnetic shield layer. The electrically conductive electromagnetic shield layer is disposed between the electrically insulating inner surface and the outer electrically insulating surface. The lighting driver circuit is electrically connected to the electrically conductive electromagnetic shield layer of the housing.

In one or more embodiments, the lighting driver circuit is electrically connected to the electrically conductive electromagnetic shield layer by one of a screw, a rivet, and a bolt.

In one or more embodiments, the electrically conductive electromagnetic shield layer of the housing includes a boss which extends through a hole in the electrically insulating inner surface of the housing.

In one or more embodiments, the lighting driver circuit is electrically connected to the electrically conductive electromagnetic shield layer by a screw or a bolt, wherein the electrically conductive electromagnetic shield layer of the housing includes a threaded boss which extends through a hole in the electrically insulating inner surface of the housing, and wherein the screw or bolt is mated with the threaded boss. The housing may completely or partially enclose the lighting driver circuit.

In one or more embodiments, the lighting driver circuit includes a rectifier and a full bridge converter connected to an output of the rectifier. In one version of these embodiments, the electrically conductive electromagnetic shield layer of the housing is directly connected to an input terminal of the rectifier, which is in turn connected to one of the pair of input terminals of the lighting driver circuit. In other version of these embodiments, the electrically conductive electromagnetic shield layer of the housing is directly connected to an output terminal of the rectifier, which is in turn connected to the full bridge converter. The electrically conductive electromagnetic shield layer of the housing can be directly connected to a ground point of the full bridge converter.

In one or more embodiments, the apparatus further includes a copper layer disposed between the electrically conductive electromagnetic shield layer and the electrically insulating inner surface.

In one or more embodiments, the electrically conductive electromagnetic shield layer includes a solid metal layer, e.g. including steel.

In one or more embodiments, the electrically conductive electromagnetic shield layer includes a polymer material having a plurality of ferromagnetic fibers embedded therein. The housing may include a plastic layer that provides the electrically insulating inner surface.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers).

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based light sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, and other types of electroluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry; a lighting driver) relating to the operation of the light source(s). An "LED-based lighting unit" refers to a lighting unit that includes one or more LED-based light sources as discussed above, alone or in combination with other non LED-based light sources.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Existing plastic housings for lighting driver circuits have various drawbacks, including drawbacks related to radiated electromagnetic emissions, immunity from electromagnetic interference and common mode current. Existing metallic housings for lighting driver circuits have various drawbacks, including drawbacks related to conducted electromagnetic emissions, leakage current, and common mode surge capabilities.

Thus, Applicants have recognized and appreciated that it would be beneficial to provide a lighting driver which has a housing which can address one or more of these shortcomings by providing: relatively low electromagnetic emissions, conducted electromagnetic emissions, leakage current, and common mode current; and relatively high immunity from electromagnetic interference and common mode surge capabilities.

In view of the foregoing, various embodiments and implementations of the present invention are directed a lighting driver and a housing for a lighting driver which has electrically insulating inner and outer surfaces and an internal electromagnetic shielding layer.

As mentioned above and would be apparent to anyone of ordinary skill in the art, in general plastic does not provided any electromagnetic shielding for electronic circuits. Accordingly, a plastic housing or enclosure does not provide any electromagnetic shielding to protect an electronic circuit, such as a lighting driver circuit, from deleterious effects of exposure to external electromagnetic interference (EMI), nor does it shield any electromagnetic radiation generated by the electronic circuit from being radiated so as to possibly interfere with other electronic circuits.

Accordingly, in many applications, a housing for an electronic circuit consists of an electromagnetic shielding material, such as a metal.

Figure 1:
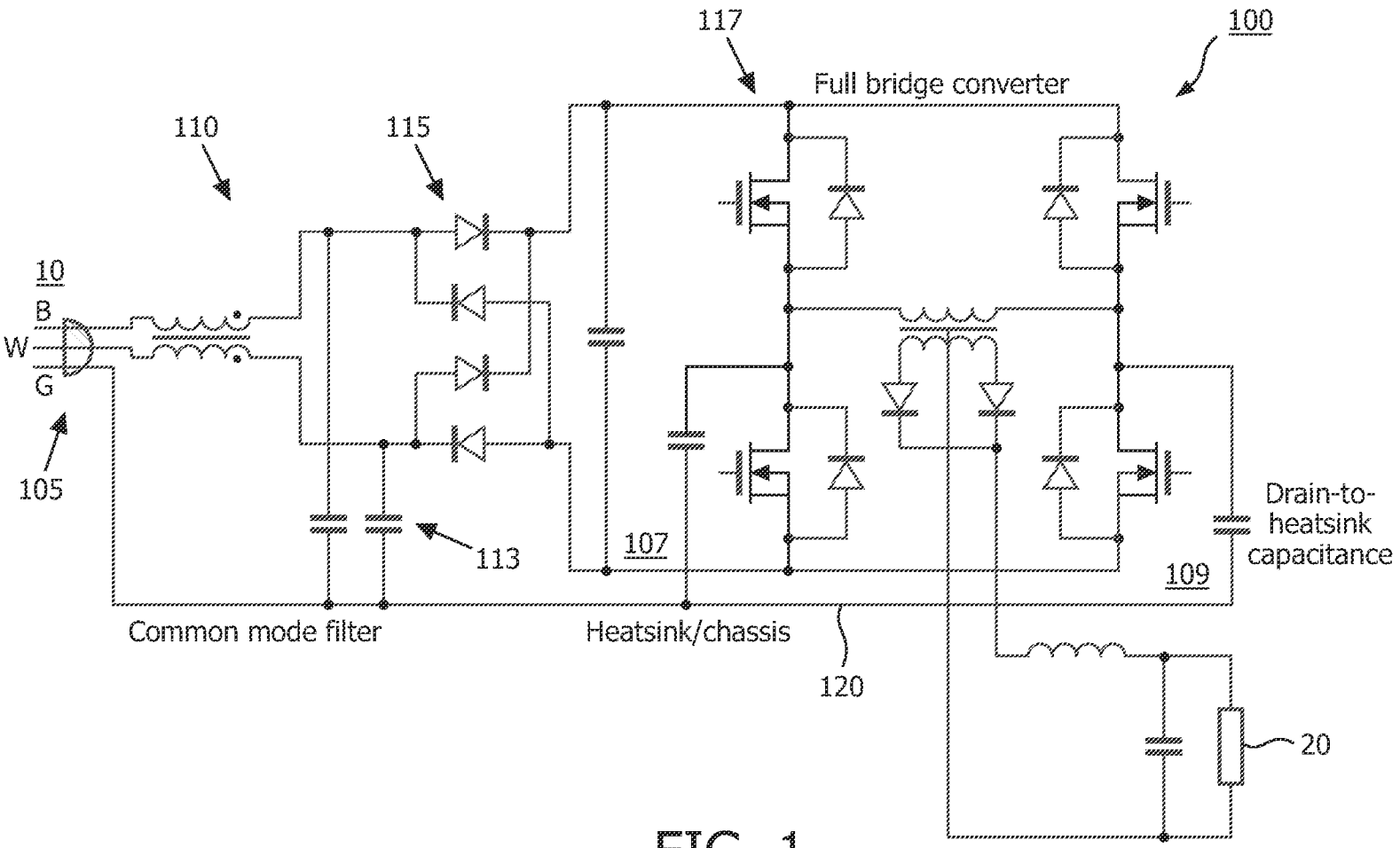
FIG. 1 illustrates one example of a lighting driver circuit that is provided with a metallic housing.

To better illustrate some of the issues related to existing metallic housings or enclosures for electronic circuits such as lighting driver circuits, FIG. 1 illustrates one example of a lighting driver 100 that includes a lighting driver circuit 110 provided with a metallic housing or chassis 120. In some embodiments, the metallic housing 120 may also function as a heat sink for lighting driver circuit 110, or be connected to such a heat sink which is also typically metallic and electrically conducting. The example lighting driver circuit 110 includes a common mode filter 113, a rectifier 115 and a full bridge converter 117 connected to the output of rectifier 115. Common mode filter 113 includes a pair of capacitors connected between each of the input nodes of rectifier 115 and the metallic housing or chassis 120.

In some embodiments, lighting driver 100 may be part of a lighting unit, for example an LED-based lighting unit, installed in a lighting fixture. Such a lighting unit may include one or more light sources, for example LED-based light sources, which receive power from lighting driver 100.

In operation, lighting driver 100 is connected to an external power supply (e.g., AC Mains) via three connections or wires 105 which are typically colored black, white, and green and are labeled B, W and Gin FIG. 1. Here it is assumed that an AC input voltage (e.g., 110-120 VAC) 10 is supplied via the B and W wires 105, and that the G wire 105 is connected to earth ground. For electrical safety reasons, metallic housing or chassis 120 is connected to earth ground via the G wire 105.

In response to input voltage 10, lighting driver 100 supplies power to a load 20, which may include one of more light sources. In some embodiments, load 20 includes one or more light emitting diodes (LEDs), e.g. one or more LED strings. In that case, lighting driver circuit 110 may be configured to supply power to load 20 in an appropriate format that is tailored to the nature of the load. For example, where load 20 includes one or more LEDs, lighting driver circuit 110 may operate as a current source for supplying a required current to the LEDs to provide a desired illumination. In operation, lighting driver 100 may include a controller (not shown in FIG. 1), or may be connected to an external controller, for controlling switching operations of full bridge converter 117 (i.e., be connected to the gates of the transistors of full bridge converter 117 shown in FIG. 1).

In lighting driver 100, there is a parasitic capacitance 107 between the common node of the input transistors of full bridge converter 117 and metallic housing or chassis 120, and a parasitic capacitance 109 between the common node of the input transistors of full bridge converter 117 and metallic housing or chassis 120. These capacitances could cause a common mode current. Common mode filter 113 is provided to reduce the common mode current and for safety. However, common mode filter 113 also provides a path for a leakage current from lighting driver circuit 110 and limits the common mode surge handling capability of lighting driver circuit 110. As the capacitors in common mode filter 112 are increased so as to decrease their impedance, the common mode current is filtered better, but the leakage current increases and the common mode surge handling capability is decreased. Conversely, as the capacitors in common mode filter 112 are decreased so as to decrease the leakage current and increase the common mode surge handling capability, then the common mode current is increased.

Figure 2:
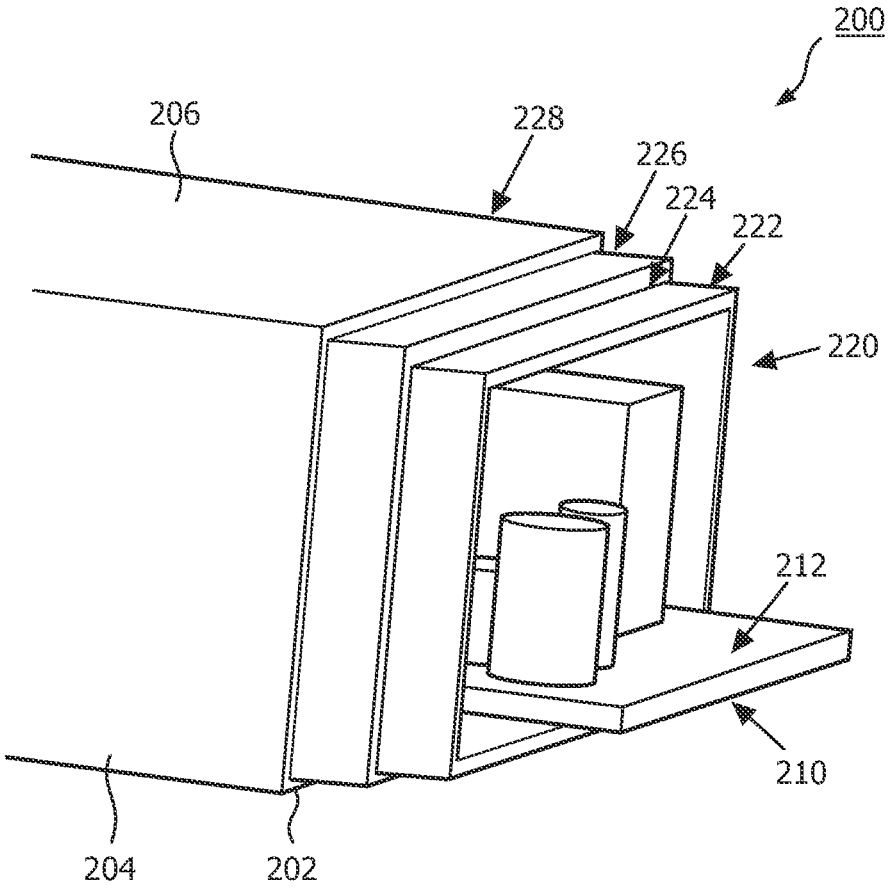
FIG. 2 illustrates a lighting driver.

FIG. 2 illustrates a lighting driver 200. Lighting driver 200 includes a lighting driver circuit 210 and a housing or enclosure 220. Lighting driver 200 may be part of a lighting unit, for example an LED-based lighting unit, installed in a lighting fixture. Such a lighting unit may include one or more light sources, for example LED-based light sources, which receive power from lighting driver 200.

Lighting driver circuit 210 includes a circuit board 212 and a plurality of electrical components 214 mounted the circuit board 212. Circuit board 212 may have one, two, or more layers and may include one or more layers for providing electrical traces or connections between electrical components 214. Circuit board 212 may include one more ground layers connected to electrical ground for the lighting driver circuit. Lighting driver circuit 210 is configured to receive an input voltage between a pair of input terminals and in response thereto to supply power to one or more light sources (e.g., LED-based light sources).

Housing 220 includes a base 202, a plurality of walls 204 connected to base 202 and to each other and each extending substantially perpendicularly from base 202, and a cover 206 separated from and spaced apart from base 202 and extending substantially perpendicularly to walls 204 and substantially in parallel with base 202 so as to define an enclosed space between base 202, cover 206 and walls 204. In the example illustrated in FIG. 2 housing 220 has the shape of a rectangular cuboid (i.e., right cuboid, rectangular hexahedron, right rectangular prism, or rectangular parallelepiped) which is colloquially referred to as a rectangular box. This is a typical shape for housing 220, but in general housing 220 may have other enclosed or substantially-enclosed shapes.

Each of base 202, cover 206, and walls 204 has an electrically insulating inner surface 222, an electrically insulating outer surface 228, and an electromagnetic shielding layer 226.

In some embodiments, electrically insulating inner surface 222 is provided in the form of an electrically insulating inner material layer or structure, and electrically insulating outer surface 228 is provided in the form of an electrically insulating material outer layer or structure. Electrically insulating inner surface 222 and electrically insulating outer surface 228 may comprise any one or combination of a variety of different materials, including but not limited to plastic (e.g., thermoplastic, ABS), bakelite, ceramic, rubber (e.g., silicone rubber), capton, PVC, acrylic, fiberglass, acrylic, beryllium oxide, TFE (e.g., TEFLON), G10 or other epoxy/fiberglass laminates, phenolic, mica, etc.

Electromagnetic shielding layer 226 may include, or be formed out of, a sheet metal, a metal screen, a metal foam, or a material impregnated with ferromagnetic fiber filler materials. Any holes in electromagnetic shielding layer 226 should be significantly smaller than the wavelength of any electromagnetic radiation that is being shielded. Beneficially, electromagnetic shielding layer 226 is also electrically conductive. In some embodiments, electromagnetic shielding layer 226 includes a material such as steel.

Beneficially, one or more of the base 202, cover 206 and walls 204 of housing 220 further includes a copper coating or layer 224 disposed on an inner surface of electromagnetic shielding layer 226, between electromagnetic shielding layer 226 and inner surface 222. Copper layer 224 may provide improved electrical conductivity especially in a case where the electrical conductivity of electromagnetic shielding layer 226 is less than what is desired. Some embodiments may omit copper layer 224.

Figure 3:
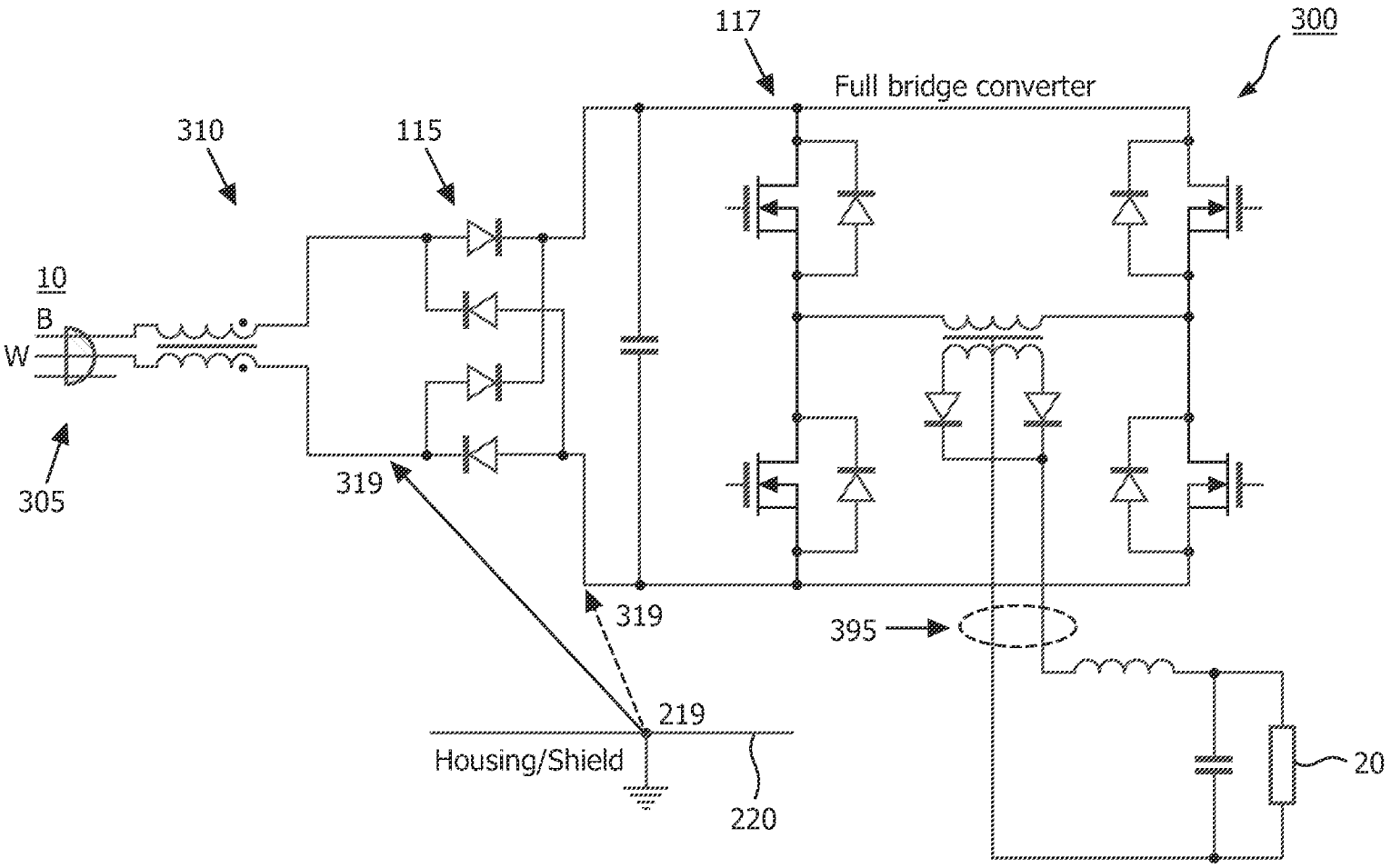
FIG. 3 illustrates one example of a lighting driver that is provided with a housing such as that shown in FIG. 2.

FIG. 3 illustrates one example of a lighting driver 300 that includes a lighting driver circuit 310 which is provided with a housing, such as housing 220 shown in FIG. 2. In some embodiments, lighting driver 300 may be part of a lighting unit, for example an LED-based lighting unit, installed in a lighting fixture. Such a lighting unit may include one or more light sources, for example LED-based light sources, which receive power from lighting driver 300.

In response to input voltage 10, lighting driver 300 supplies power via output connections or wires 395 to a load 20, including one of more light sources. In some embodiments, load 20 may include one or more light emitting diodes (LEDs), e.g. one or more LED strings. In that case, lighting driver circuit 310 may be configured to supply power to load 20 in an appropriate format that is tailored to the nature of the load. For example, where load 20 includes one or more LEDs, lighting driver circuit 310 may operate as a current source for supplying a required current to the LEDs. In operation, lighting driver 300 may include a controller (not shown in FIG. 3), or may be connected to an external controller for controlling switching operations of full bridge converter 117 (i.e., be connected to the gates of the transistors of full bridge converter 117 shown in FIG. 3).

In operation, lighting driver circuit 310 is connected to an external power supply (e.g., AC Mains) via two connections or wires 305 which are typically colored black and white are labeled B and W in FIG. 3. Here it is assumed that an AC input voltage (e.g., 110-120 VAC) 10 is supplied via the B and W wires 305. It is noted that the G connection or wire (e.g., earth ground) of the external power supply (e.g., AC Mains) is not connected to lighting driver 300, as housing 220 is provided with electrically insulating outer surface 228 which eliminates a risk of electrical shock to a human being who may come in contact with lighting driver 300. However, housing 220, and specifically an electrically conducting inner layer of housing 220, is connected—e.g., directly connected—to an electrical ground 319 of lighting driver circuit 310 at a single point 219. In some embodiments, the electrically conducting inner layer may include electromagnetic shielding layer 226 and/or copper layer 224. FIG. 3 illustrates two possible alternative points 319 for lighting driver circuit 310 to be electrically connected to housing 220. One possible connection point 319 is at an electrical ground point at the input of full bridge converter 117 (at the output of rectifier 115). Another alternative connection point 319 is at an electrical ground point at the input of rectifier 115. As explained in further detail below, in some embodiments the electrical connection may be made by way of a screw, a rivet, and a bolt which is attached to a boss (e.g., a threaded boss) provided in the electromagnetic shielding layer 226 of housing 220.

As can be seen in FIG. 3, because of the configuration of housing 220, lighting driver circuit 310 may omit the common mode filter that is employed in lighting driver circuit 110 which has the metal housing 120. Accordingly, lighting driver 300 may exhibit relatively good conducted electromagnetic interference (EMI) performance, without the leakage current and common mode surge issues that may plague lighting driver 100. Furthermore, since housing 200 includes an internal electromagnetic shielding layer, lighting driver 200 may further exhibit good EMC shielding performance, and relatively low levels of radiated EMI, in contrast to a lighting driver which employs a housing consisting of plastic.

Figure 4A:
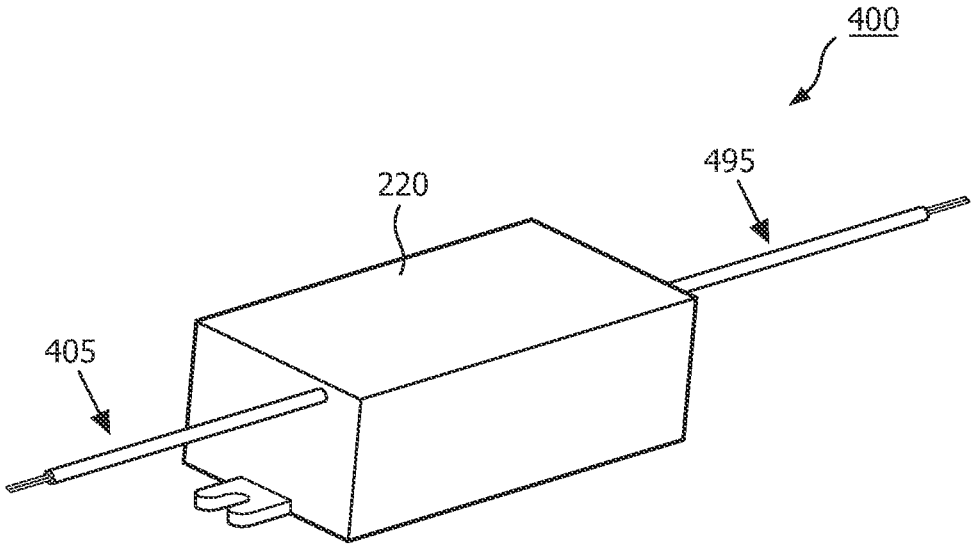
FIG. 4A illustrates one embodiment of a lighting driver

FIG. 4A illustrates one embodiment of a lighting driver 400, which may be an example of lighting driver 200 and/or 300. Here again, housing or enclosure 220 for lighting driver 400 is illustrated as a rectangular box, but it should be understood that housing 220 may take on virtually any closed shape that is desired. It is noted that FIG. 4A illustrates how lighting driver 400 receives its input voltage or power via only the two wires 405 (e.g., the B and W wires), and supplies power to its load 20 via two other wires 495.

Figure 4B:
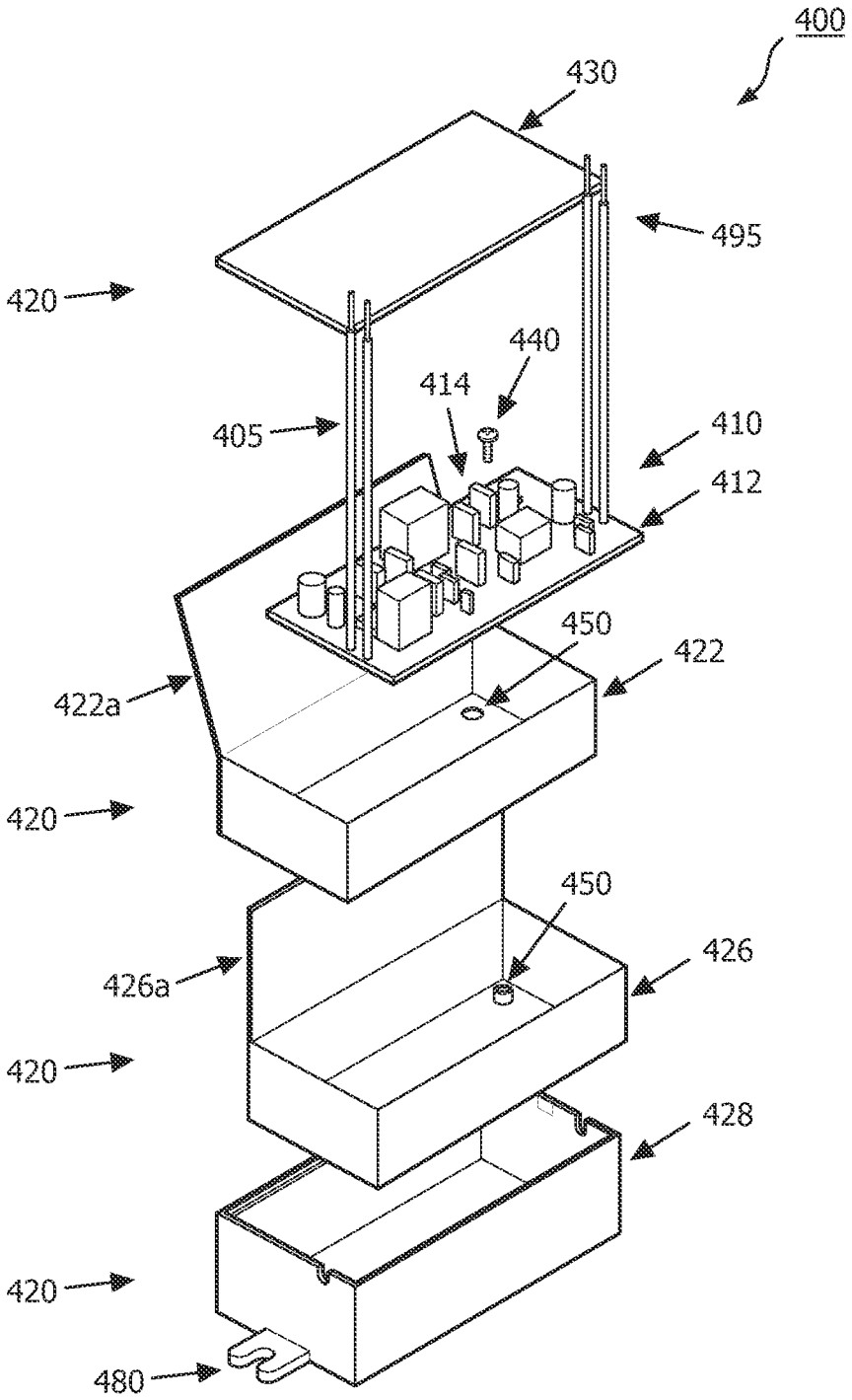
FIG. 4B illustrates an assembly diagram for a lighting driver including a lighting driver circuit and a first embodiment of a housing.

FIG. 4B illustrates an assembly diagram for lighting driver 400, including lighting driver circuit 410 and a first embodiment of a housing 420. Lighting driver circuit 410 includes a circuit board (e.g., printed circuit board or PCB) 412 and a plurality of electrical components 414 mounted the circuit board 412. Circuit board 412 may have one, two, or more layers and may include one or more layers for providing electrical traces or connections between electrical components 414. Circuit board 412 may include one more ground layers connected to electrical ground for the lighting driver circuit. Lighting driver circuit 410 is configured to receive an input voltage between a pair of input terminals and in response thereto to supply power to one or more light sources (e.g., LED-based light sources). Housing 420 includes an electrically insulating inner structure 422, an internal electromagnetic shielding structure 426, an electrically insulating outer structure or chassis 428, and a cover 430.

Electrically insulating inner structure 422 and electrically insulating outer structure or chassis 428 may include any one or combination of a variety of different materials, including but not limited to plastic (e.g., thermoplastic, ABS), bakelite, ceramic, rubber (e.g., silicone rubber), capton, PVC, acrylic, fiberglass, acrylic, beryllium oxide, TFE (e.g., TEFLON), G10 or other epoxy/fiberglass laminates, phenolic, mica, etc.

Electrically insulating inner structure 422 includes a top flap or hinged cover 422*a* which may be folded over the rest of electrically insulating inner structure 422 to define an enclosed space.

Electromagnetic shielding structure 426 may include, or be formed out of, a sheet metal, a metal screen, a metal foam, or a material impregnated with ferromagnetic fiber filler materials. Any holes in electromagnetic shielding structure 426 should be significantly smaller than the wavelength of any electromagnetic radiation that is being shielded. Beneficially, electromagnetic shielding structure 426 is also electrically conductive. In some embodiments, electromagnetic shielding structure 426 includes a material such as steel. Electromagnetic shielding structure 426 includes a top flap hinged cover 426*a*.

Beneficially, electromagnetic shielding structure 426 has a copper layer or coating, not shown in FIG. 4, disposed on an inner surface thereof between electromagnetic shielding structure 426 and electrically insulating inner structure 422. The copper layer or coating may provide improved electrical conductivity especially in a case where the electrical conductivity of electromagnetic shielding structure 426 is less than what is desired. Some embodiments may omit the copper layer or coating.

As illustrated in FIG. 4B, electromagnetic shielding structure 426 includes an insert or boss 450, which beneficially may be internally threaded. Electrically insulating inner structure 422 includes a corresponding aperture 460 which exposes boss 450. Lighting driver circuit 410 and housing 420, and particularly electromagnetic shielding structure 426 and/or a copper coating provided thereon, by means of an attachment means 440, which for example may be a screw, a bolt, a rivet, etc.

Lighting driver 400 may be assembled as follows. Electromagnetic shielding structure 426, which as noted above may include a copper coating or layer, is placed within electrically insulating outer structure 428. Electrically insulating inner structure 422 is placed inside of electromagnetic shielding structure 426. Lighting driver circuit 410 including circuit board 412 is placed within electrically insulating inner structure 422. Attachment means 440 (e.g., a screw is mated with boss 450 through a hole in circuit board 412 to provide a single-point electrical connection between housing 420 and lighting driver circuit 410. Wires 405 and 495 are routed through enclosure slot openings in housing 420. Then, hinged covers 422*a* and 426*s* are folded over the rest of insulating inner structure 422 to form an enclosed space with lighting driver circuit 410 disposed therein. Finally, cover 430 is snap fit into electrically insulating outer structure or chassis 428, closing the housing as shown FIG. 4A. Then lighting driver 400 may be installed or mounted in a lighting fixture by means of one or more mounting feet 480 provided to electrically insulating outer structure 428.

Figure 5A:
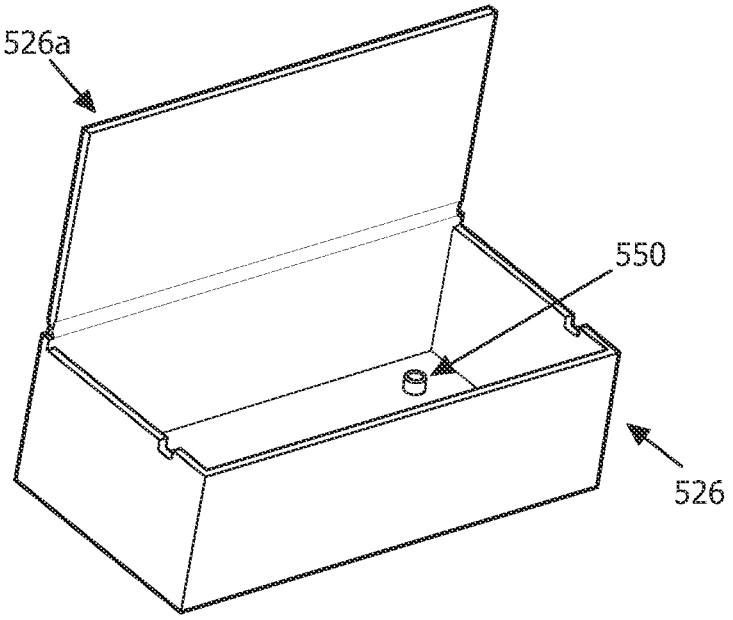
FIG. 5A illustrates one embodiment of an internal electromagnetic shielding layer for a housing.

FIG. 5A illustrates one embodiment of an internal electromagnetic shielding layer or structure 526 for a housing. Electromagnetic shielding structure 526 may be formed by an injection molding process. In some embodiment, electromagnetic shielding structure 526 is made of a plastic polymer with ferromagnetic fiber fillers to achieve electrical conductivity for EMI shielding and immunity. As shown in FIG. 5A, electromagnetic shielding structure 526 includes a top flap or hinged cover 526*a* and a boss (e.g., a threaded boss) 550. Beneficially, the ferromagnetic fiber fillers render electromagnetic shielding layer 526 electrically conductive.

Figure 5B:
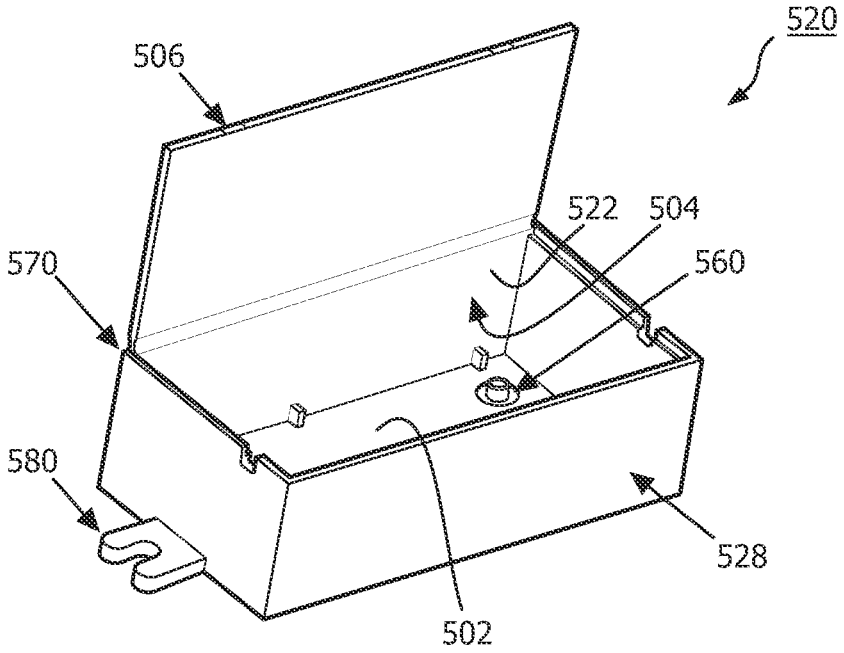
FIG. 5B illustrates one embodiment of a housing that includes the internal electromagnetic shielding layer of FIG. 5A.

FIG. 5B illustrates one embodiment of a housing 520 that includes the internal electromagnetic shielding layer 526 of FIG. 5A.

Housing 520 includes a base 502, a plurality of walls 504 connected to base 502 and to each other and each extending substantially perpendicularly from base 502, and a cover 506 separated from and spaced apart from base 502 and extending substantially perpendicularly to walls 504 and substantially in parallel with base 502 so as to define an enclosed space between base 502, cover 506 and walls 504. In the example illustrated in FIG. 5B housing 520 has the shape of a rectangular box, but it should be understood that the housing may take on virtually any closed shape that is desired.

Beneficially, housing 520 may further include a copper coating or layer (not shown in FIG. 5B) disposed on an inner surface of electromagnetic shielding layer 526 which may provide improved electrical conductivity especially in a case where the electrical conductivity of electromagnetic shielding layer 526 is less than what is desired. Some embodiments may omit this copper coating or layer.

Housing 520 may be formed by over molding an electrically insulating plastic so as to sandwich electromagnetic shielding layer 526. Beneficially, the mold tooling provides a shut-off feature 560 as shown in FIG. 5B to keep the electrically insulating plastic from flowing over electromagnetic shielding layer 226 in the area of boss 550. This will allow an attachment means (e.g., a screw) to make an electrical connection to the circuit board of a lighting driver circuit. The electrically insulating plastic should be compatible with the plastic material of electromagnetic shielding layer 526 so that the materials are chemically bonded to produce a one-piece housing 520. Furthermore, the electrically insulating plastic should have a thermal coefficient of expansion which is the same as, or similar to, the plastic material of electromagnetic shielding layer 526.

Figure 5C:
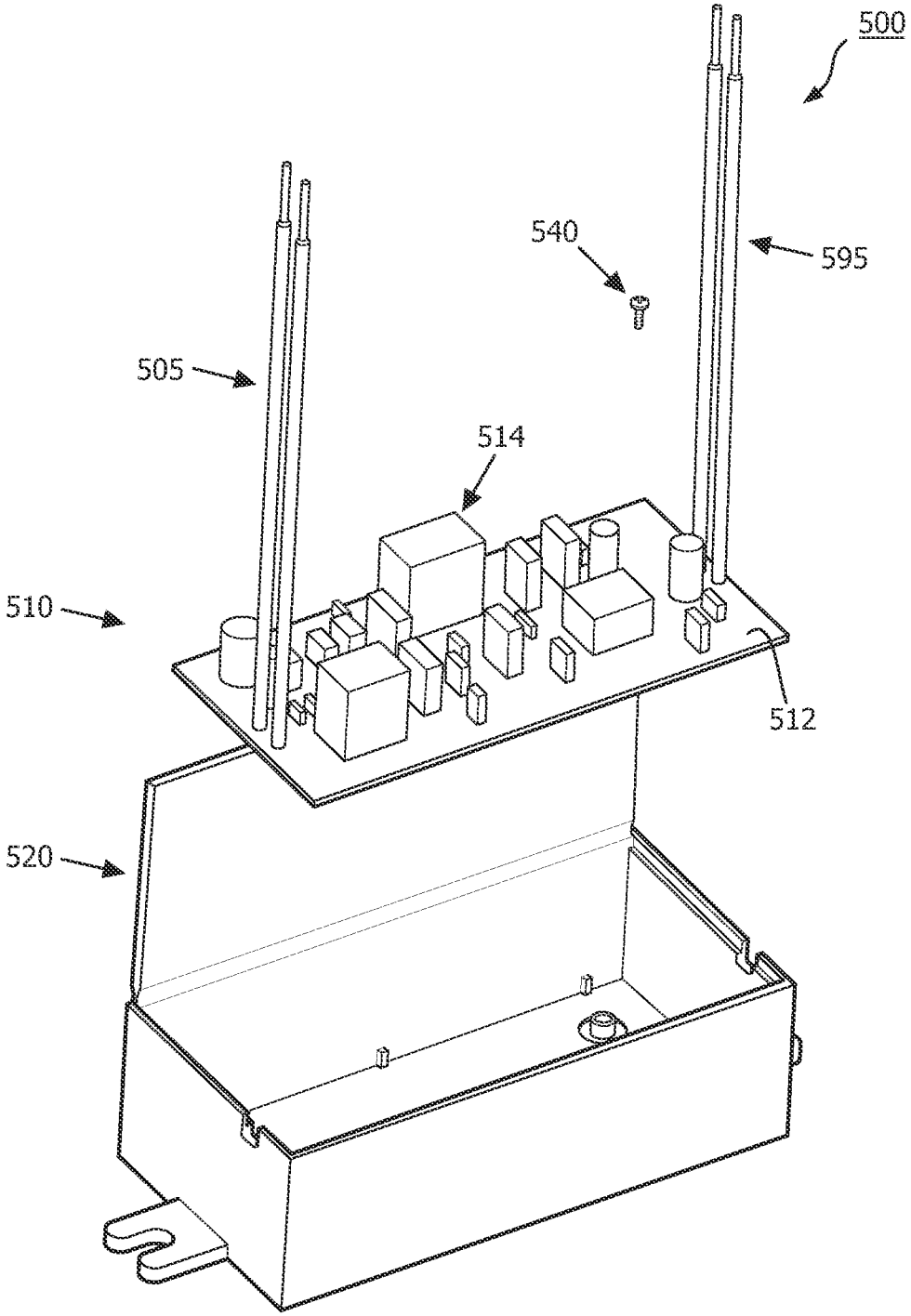
FIG. 5C illustrates assembly of a lighting driver including a lighting driver circuit and the housing of FIG. 5B.

FIG. 5C illustrates assembly of a lighting driver 500, including a lighting driver circuit 510 and housing 520. Lighting driver circuit 510 includes a circuit board (e.g., printed circuit board or PCB) 512 and a plurality of electrical components 514 mounted the circuit board 512. Circuit board 512 may have one, two, or more layers and may include one or more layers for providing electrical traces or connections between electrical components 514. Circuit board 512 may include one more ground layers connected to electrical ground for the lighting driver circuit. Lighting driver circuit 510 is configured to receive an input voltage between a pair of input terminals and in response thereto to supply power to one or more light sources (e.g., LED-based light sources).

Lighting driver 500 may be assembled as follows. Lighting driver circuit 410 is placed into a cavity defined by base 502 and walls 504 of housing 520. Attachment means 540 (e.g., a screw) is mated with the threaded 550 through a hole in circuit board 510 through a hole in circuit board 512 to provide a single-point electrical connection between housing 520 and lighting driver circuit 510. Wires 505 and 595 are routed through enclosure slot openings in housing 520. Cover 506 of housing 520 is folded over and secured by snap fits to the remainder of housing 520 to form an enclosed space with lighting driver circuit 510 disposed therein. Then lighting driver 500 may be installed or mounted in a lighting fixture by means of one or more mounting feet 580 provided to housing 520.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. In particular, while embodiments have been described above wherein certain housings are employed for lighting driver circuits, it should be understood from the drawings and the descriptions above that these housings may be employed in general with a wide variety of other electronic circuits. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

Also, reference numerals appearing between parentheses in the claims, if any, are provided merely for convenience and should not be construed as limiting the claims in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

The invention claimed is:

1. An apparatus, comprising:

a housing including, a base, a plurality of walls connected to the base and to each other and each extending substantially perpendicularly from the base, and a cover separated from and spaced apart from the base and extending substantially perpendicularly to the walls and substantially in parallel with the base so as to define an enclosed space between the base, the cover and the walls, wherein the housing comprises an electrically insulating inner surface and an electrically insulating outer surface and an electrically conductive electromagnetic shield layer comprising a ferromagnetic material, wherein the electrically conductive electromagnetic shield layer is disposed between the electrically insulating inner surface and the electrically insulating outer surface; and a lighting driver circuit including a circuit board and a plurality of electrical components mounted on the circuit board, the lighting driver circuit being configured to receive an input voltage between a pair of input terminals and in response thereto to supply power to one or more light sources, wherein the lighting driver circuit is disposed within the enclosed space such that the electrically insulating inner layers of the housing are disposed between the lighting driver circuit and the electrically conductive electromagnetic shield layers of the housing, and wherein a ground point of the lighting driver circuit is electrically connected to at least one of the electrically conductive electromagnetic shield layers of the housing via a single electrical connection.

2. The apparatus of claim 1, wherein the electrically conductive electromagnetic shield layers of the housing are all connected together.

3. The apparatus of claim 1, wherein the single electrical connection between the lighting driver circuit and the electrically conductive electromagnetic shield layer comprises one of a screw, a rivet, and a bolt.

4. The apparatus of claim 3, wherein the electrically conductive electromagnetic shield layer of the housing includes a boss which extends through a hole in the electrically insulating inner surface of the housing.

5. The apparatus of claim 4, wherein the boss is threaded, wherein the single electrical connection comprises a screw or a bolt, and wherein the screw or bolt is inserted within the threaded boss.

6. The apparatus of claim 1, wherein the base, the cover, and the walls each further comprise a copper layer disposed between the electrically conductive electromagnetic shield layer and the electrically insulating inner surface.

7. An apparatus, comprising:

a lighting driver circuit configured to receive an input voltage between a pair of input terminals and in response thereto to supply power to one or more light sources; and a housing in which the lighting driver circuit is disposed, the housing having an electrically insulating inner surface and an electrically insulating outer surface and an electrically conductive electromagnetic shield layer, wherein the electrically conductive electromagnetic shield layer is disposed between the electrically insulating inner surface and the electrically insulating outer surface, wherein the lighting driver circuit is electrically connected to the electrically conductive electromagnetic shield layer of the housing, wherein the lighting driver circuit comprises a rectifier and a full bridge converter connected to an output of the rectifier, wherein the electrically conductive electromagnetic shield layer of the housing is directly connected to an input terminal of the rectifier, which is in turn connected to one of the pair of input terminals of the lighting driver circuit.

8. The apparatus of claim 7, wherein the lighting driver circuit is electrically connected to the electrically conductive electromagnetic shield layer by one of a screw, a rivet, and a bolt.

9. The apparatus of claim 7, wherein the electrically conductive electromagnetic shield layer of the housing includes a boss which extends through a hole in the electrically insulating inner surface of the housing.

10. The apparatus of claim 7, wherein the lighting driver circuit is electrically connected to the electrically conductive electromagnetic shield layer by a screw or a bolt, wherein the electrically conductive electromagnetic shield layer of the housing includes a threaded boss which extends through a hole in the electrically insulating inner surface of the housing, and wherein the screw or bolt is mated with the threaded boss.

11. The apparatus of claim 7, wherein the housing completely encloses the lighting driver circuit.

12. The apparatus of claim 7, wherein the electrically conductive electromagnetic shield layer of the housing is directly connected to an output terminal of the rectifier, which is in turn connected to the full bridge converter.

13. The apparatus of claim 7, further comprising a copper layer disposed between the electrically conductive electromagnetic shield layer and the electrically insulating inner surface.

14. The apparatus of claim 13, where the solid metal layer is steel.

15. The apparatus of claim 7, where the electrically conductive electromagnetic shield layer comprises a solid metal layer.

16. The apparatus of claim 7, where the electrically conductive electromagnetic shield layer comprises a polymer material having a plurality of ferromagnetic fibers embedded therein.

17. The apparatus of claim 7, wherein the housing comprises a plastic layer that provides the electrically insulating inner surface.

18. An apparatus, comprising:

a lighting driver circuit configured to receive an input voltage between a pair of input terminals and in response thereto to supply power to one or more light sources; and a housing in which the lighting driver circuit is disposed, the housing having an electrically insulating inner surface and an electrically insulating outer surface and an electrically conductive electromagnetic shield layer, wherein the electrically conductive electromagnetic shield layer is disposed between the electrically insulating inner surface and the electrically insulating outer surface, wherein the lighting driver circuit is electrically connected to the electrically conductive electromagnetic shield layer of the housing, wherein the lighting driver circuit comprises a rectifier and a full bridge converter connected to an output of the rectifier wherein the electrically conductive electromagnetic shield layer of the housing is directly connected to a ground point of the full bridge converter.

* * * * *